US009285732B2

(12) United States Patent
Shibahara

(10) Patent No.: US 9,285,732 B2
(45) Date of Patent: Mar. 15, 2016

(54) IMAGE FORMING APPARATUS AND FIXING OPERATION CONTROL METHOD

(71) Applicant: KYOCERA Document Solutions Inc., Osaka-shi, Osaka (JP)

(72) Inventor: Masami Shibahara, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/254,709

(22) Filed: Apr. 16, 2014

(65) Prior Publication Data

US 2014/0314436 A1 Oct. 23, 2014

(30) Foreign Application Priority Data

Apr. 22, 2013 (JP) ..... 2013-089696
Feb. 26, 2014 (JP) ..... 2014-036049

(51) Int. Cl.
*G03G 15/20* (2006.01)

(52) U.S. Cl.
CPC ..... *G03G 15/205* (2013.01); *G03G 2215/2045* (2013.01)

(58) Field of Classification Search
CPC ..... G03G 15/2014; G03G 15/2039; G03G 15/2078; G03G 2215/2045; G03G 2215/00949; G03G 2215/0196
See application file for complete search history.

(56) References Cited

U.S. PATENT DOCUMENTS

2004/0136025 A1* 7/2004 Moriyama ..... H04N 1/00002 358/1.14
2011/0081158 A1* 4/2011 Wagatsuma ..... G03G 15/2039 399/70
2012/0020716 A1* 1/2012 Hashimoto ..... B41J 13/0009 400/582

FOREIGN PATENT DOCUMENTS

JP 2002132086 A * 5/2002
JP 2006251441 A 9/2006
JP 2006267872 A 10/2006
JP 2012058629 A 3/2012

OTHER PUBLICATIONS

JP_2002132086_A_T Machine Translation.*
JP_2002132086_A_T Machine Translation (Jun. 9, 2015).*

* cited by examiner

*Primary Examiner* — Clayton E LaBalle
*Assistant Examiner* — Victor Verbitsky
(74) *Attorney, Agent, or Firm* — Alleman Hall McCoy Russell & Tuttle LLP

(57) ABSTRACT

An image forming apparatus includes an operation control portion, and an operation mode setting portion. Operation control portion performs control in either operation mode of first operation mode where operation control portion controls heating portion so that heat transfer portion is first target temperature, and controls conveying portion so that conveying speed of sheet is first speed; and second operation mode where operation control portion controls heating portion so that heat transfer portion is second target temperature, and controls conveying portion so that conveying speed of sheet is second speed. Operation mode setting portion, under condition that first print job has been input, sets operation mode of operation control portion to first operation mode, and when second print job input after first print job has satisfied predetermined condition, sets operation mode of operation control portion to second operation mode.

4 Claims, 4 Drawing Sheets

IMAGE FORMING APPARATUS AND FIXING OPERATION CONTROL METHOD

INCORPORATION BY REFERENCE

This application is based upon and claims the benefit of priority from the corresponding Japanese Patent Application No. 2013-089696 filed on Apr. 22, 2013, and No. 2014-036049 filed on Feb. 26, 2014, the entire contents of which are incorporated herein by reference.

BACKGROUND

The present disclosure relates to an image forming apparatus including a heating portion configured to raise the temperature of a heating roller, and relates to a fixing operation control method applied to the image forming apparatus.

An image forming apparatus using an electrophotographic method includes a fixing device for fixing on a print sheet a toner image transferred onto the print sheet. The fixing device includes: a heating device such as a heater; a heating roller (a rotating member), the surface of which is heated by the heating device; and a pressure roller which is brought into pressure contact with and driven by the heating roller. The heating roller is rotatably supported by the fixing device and is driven to rotate by a driving force transmitted to the heating roller. When a print sheet has been conveyed to a nip portion formed between the heating roller and the pressure roller, then during the conveyance of the print sheet by the heating roller and the pressure roller, a toner image on the print sheet is fused by the heat of the heating roller and fixed on the print sheet by the pressurization of the pressure roller. Further, in the fixing device, a temperature sensor detects the surface temperature of the heating roller, and based on the detection result, the heating of the heating device is controlled so that the temperature in the nip portion is a fixing temperature, which enables the fixing of toner.

Conventionally, this kind of fixing device includes a power saving function for reducing the power consumed when the heating device performs heating. The conventional power saving function stops the heating of the heating device until the input of a print job. Then, when a print job has been input, the conventional power saving function starts the heating of the heating device and controls the temperature of the heating roller to rise to the fixing temperature. Then, while a fixing process is being performed at the fixing temperature, the power saving function performs constant temperature control to maintain the temperature of the heating roller at the fixing temperature. Further, when the print job has been completed, the power saving function stops the heating of the heating device, or performs standby temperature control for maintaining the temperature of the heating roller at a temperature lower than the fixing temperature.

It should be noted that a fixing device or an image forming apparatus including various power saving functions is known as the conventional art. For example, an apparatus capable of selecting between an ecology-oriented mode and a printing-time-oriented mode is known. An apparatus capable of setting a plurality of modes such as a normal mode and an energy-saving mode is known. Further, an apparatus that changes a fixing speed in accordance with the number of print sheets to pass through a fixing device is known.

SUMMARY

An image forming apparatus according to one aspect of the present disclosure includes a heat transfer portion, a heating portion, a conveying portion, an operation control portion, and an operation mode setting portion. The heat transfer portion is configured to transfer heat to a sheet on which an image is to be formed, to heat the sheet. The heating portion is configured to raise a temperature of the heat transfer portion. The conveying portion is configured to convey the sheet. The operation control portion is configured to perform control in either operation mode of: a first operation mode where the operation control portion controls the heating portion so that the temperature of the heat transfer portion is a first target temperature, and also controls the conveying portion so that a conveying speed of the sheet is a first speed; and a second operation mode where the operation control portion controls the heating portion so that the temperature of the heat transfer portion is a second target temperature which is higher than the first target temperature, and also controls the conveying portion so that the conveying speed of the sheet is a second speed which is faster than the first speed. The operation mode setting portion is configured to, under the condition that a first print job has been input, set the operation mode of the operation control portion to the first operation mode, and when a second print job input after the first print job has satisfied a predetermined condition, set the operation mode of the operation control portion to the second operation mode by allowing the first operation mode to transition to the second operation mode.

Further, a fixing operation control method according to another aspect of the present disclosure is a fixing operation control method applied to an image forming apparatus that includes: a conveying portion configured to convey a sheet on which an image is to be formed; a heat transfer portion configured to transfer heat to the sheet conveyed by the conveying portion, to heat the sheet; and a heating portion configured to raise a temperature of the heat transfer portion. The fixing operation control method includes a first step and a second step. In the first step, under the condition that a first print job has been input, the heating portion is controlled so that the temperature of the heat transfer portion is a first target temperature, and the conveying portion is also controlled so that a conveying speed of the sheet is a first speed. In the second step, when a second print job input after the first print job has satisfied a predetermined condition, the heating portion is controlled so that the temperature of the heat transfer portion is a second target temperature which is higher than the first target temperature, and the conveying portion is also controlled so that the conveying speed of the sheet is a second speed which is faster than the first speed.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described in detail based on the drawings as appropriate. It should be noted that the following embodiment is merely a specific example of the present disclosure, and does not limit the technical scope of the present disclosure.

[Image Forming Apparatus 10]

Figure 1:
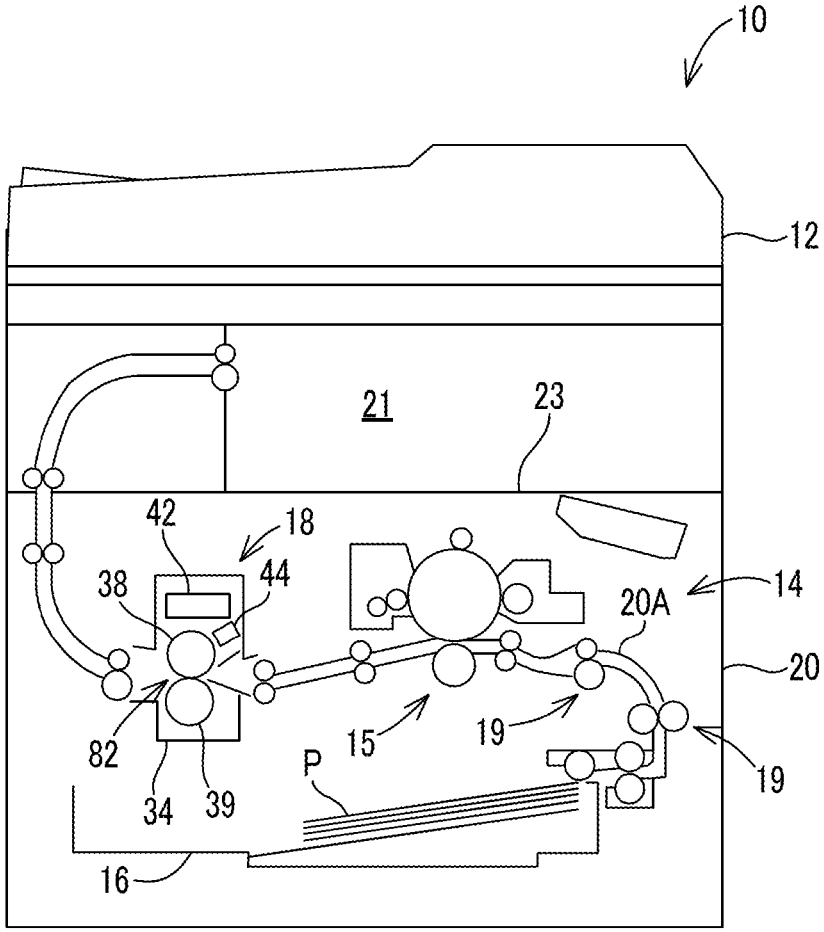
FIG. 1 is a diagram showing the configuration of an image forming apparatus according to an embodiment of the present disclosure.

FIG. 1 is a diagram showing the configuration of an image forming apparatus 10 (an example of an image forming apparatus) according to an embodiment of the present disclosure. As shown in FIG. 1, the image forming apparatus 10 forms an image on a print sheet P (an example of a sheet) based on image data of a read document or image data input from outside. The image forming apparatus 10 includes in its upper portion a scanner 12 configured to read an image on a document, and includes in its lower portion an image forming portion 14 using an electrophotographic method. It should be noted that a specific example of the image forming apparatus 10 according to the embodiment of the present disclosure is, for example, a printer, a copying machine, a facsimile, or a multifunction peripheral including the functions of these apparatuses.

The image forming portion 14 forms an image on the print sheet P based on a print job for image data read by the scanner 12 or image data input from outside. The image forming portion 14 mainly includes a sheet feed tray 16, conveying roller pairs 19 (an example of a conveying portion), a transfer device 15, a fixing device 18 (an example of a fixing device), an operation display portion (not shown), a motor 67 (see FIG. 2), and a control portion 8 (see FIG. 2) configured to control the operations of these components. The sheet feed tray 16 is configured to hold the print sheet P. The transfer device 15 transfers a toner image onto the print sheet P fed from the sheet feed tray 16. The fixing device 18 fixes on the print sheet P the toner image transferred onto the print sheet P. The motor 67 supplies a rotation driving force to a heating roller 38 (an example of a heat transfer portion) of the fixing device 18 and to the conveying roller pairs 19. These components are placed within a casing 20, which forms a housing of the image forming portion 14. Between the top of the casing 20 and the scanner 12, a sheet discharge space 21 is provided such that its front is open. On the lower surface of the sheet discharge space 21, a sheet discharge tray 23 is provided. The print sheet P fed from the sheet feed tray 16 is moved upward in a conveyance path 20A, which is delimited on the right side of the casing 20. During this movement process, the transfer device 15 transfers a toner image onto the print sheet P. The toner image transferred onto the print sheet P is heated and fused by heat received from the heating roller 38 when the print sheet P passes through the fixing device 18. This fixes the toner image on the print sheet P. The print sheet P having passed through the fixing device 18 is discharged to the sheet discharge space 21 and held in the sheet discharge tray 23.

The plurality of conveying roller pairs 19 are provided along the conveyance path 20A. The conveying roller pairs 19 convey the print sheet P in the conveyance path 20A downstream in a conveying direction. The conveying roller pairs 19 are connected via a gear transmission mechanism (not shown) to the motor 67 the driving of which is controlled by a motor driver 66 (see FIG. 2) of the control portion 8. Thus, the motor 67 is driven to rotate, thereby transmitting the rotation driving force of the the motor 67 via the gear transmission mechanism and rotating the conveying roller pairs 19 in a predetermined direction. The motor driver 66 controls the driving of the conveying roller pairs 19, thereby conveying the print sheet P in the conveyance path 20A at one of a first speed V1 or a second speed V2 which is faster than the first speed V1. That is, the motor driver 66 drives the motor 67 to rotate so that the conveying speed of the print sheet P, by the conveying roller pairs 19, is the first speed V1 or the second speed V2. In the present embodiment, the first speed V1 is set to half the second speed V2. Such control of the motor 67 is achieved by the control portion 8 transmitting a control signal corresponding to the first speed V1 or a control signal corresponding to the second speed V2 to the motor driver 66.

[Fixing Device 18]

The fixing device 18 includes: a frame 34; the heating roller 38 which is supported by the frame 34; a pressure roller 39 which is supported by the frame 34 and is also brought into pressure contact with and driven to rotate by the heating roller 38; an induction heating device 42 (an example of a heating portion); and a temperature sensor 44. The heating roller 38 and the pressure roller 39 are rotatably supported by the frame 34.

In the fixing device 18, the induction heating device 42 raises the temperature of the heating roller 38 to fuse toner. Specifically, the induction heating device 42 generates the heat of the heating roller 38 so that the surface temperature of the heating roller 38 is either temperature (hereinafter referred to as a "fixing temperature") of 145° C. or 175° C. More specifically, the heat of the heating roller 38 is generated so that the temperature of the surface of the heating roller 38 to be detected by the temperature sensor 44 described below is either temperature (hereinafter referred to as a "fixing temperature") of 145° C. or 175° C. This heats the print sheet P passing through a nip portion 82 formed between the heating roller 38 and the pressure roller 39. Hereinafter, the lower temperature (145° C.) is referred to as a "first target temperature", and the higher temperature (175° C.) is referred to as a "second target temperature". In the present embodiment, the first target temperature is 145° C., and the second target temperature is 175° C. The first target temperature and the second target temperature, however, may only need to be set to temperatures within a temperature range that enables the fixing of an image on the print sheet P, and the second target temperature may only need to be set to a temperature higher than the first target temperature. Here, the temperature range that enables the fixing of an image on the print sheet P is a temperature range that enables the fixing of toner on the print sheet P in the fixing device 18. Such a temperature range is a factor determined by the material of toner, or the like.

As shown in FIG. 1, the induction heating device 42 provided above the heating roller 38 causes the magnetic flux to act on the heating roller 38 from one direction, thereby generating heat from the outer circumferential surface of the heating roller 38. In the present embodiment, the induction heating device 42 generates the heat of the heating roller 38, whereby the heating roller 38 heats the print sheet P passing through the nip portion 82.

The induction heating device 42 is a device configured to generate the heat of an object (the heating roller 38) by an induction heating method using electromagnetic induction. The induction heating device 42 is provided to cover the circumferential surface of the heating roller 38 with a gap therebetween. The heating roller 38 is influenced by the line of magnetic force from the induction heating device 42, thereby generating Joule heat to generate its own heat. It should be noted that another heating device such as a halogen heater can be applied instead of the induction heating device 42.

The heating roller 38 is connected via a gear transmission mechanism (not shown) to the motor 67 the driving of which is controlled by the motor driver 66 of the control portion 8. Thus, the motor 67 is driven to rotate, thereby transmitting the rotation driving force of the motor 67 via the gear transmission mechanism and rotating the heating roller 38 in a predetermined direction. Further, as described below, the heating roller 38, together with the pressure roller 39, conveys the print sheet P while nipping it. The motor driver 66 controls the driving of the heating roller 38, thereby conveying the print sheet P in the nip portion 82 at either the first speed V1 or the second speed V2 which is faster than the first speed V1. That is, the motor driver 66 drives the motor 67 to rotate so that the speed of the heating roller 38 conveying the print sheet P is the first speed V1 or the second speed V2. Such control of the motor 67 is achieved by the control portion 8 transmitting a control signal corresponding to the first speed V1 or a control signal corresponding to the second speed V2 to the motor driver 66. It should be noted that the conveying portion according to the present disclosure may be achieved by the heating roller 38 and the pressure roller 39.

The pressure roller 39 is placed to oppose the heating roller 38. The pressure roller 39 is brought into pressure contact with the heating roller 38 by a spring (not shown) or the like. This forms the nip portion 82 between the pressure roller 39 and the heating roller 38. In the fixing device 18, the print sheet P is conveyed through the nip portion 82 from right to left in FIG. 1.

In the periphery of the heating roller 38, the temperature sensor 44 configured to detect the temperature of the outer circumferential surface of the heating roller 38 is provided. A signal from the temperature sensor 44 is input to the control portion 8, and the control portion 8 controls the induction heating device 42 based on the input signal. Specifically, the control portion 8 controls the induction heating device 42 so that the temperature of the heating roller 38 is constant at either the first target temperature or the second target temperature. The temperature sensor 44 is a compact and low-cost thermistor, which is a general-purpose item. As a matter of course, the temperature sensor 44 may be any type of temperature sensor that can detect the surface temperature of the heating roller 38. For example, it is possible to apply a contact temperature sensor using thermoelectromotive force, electrical resistance, or a change in magnetism, or a non-contact temperature sensor configured to measure a temperature based on luminance, a color, the intensity of infrared light, or the like.

[Control Portion 8]

Figure 2:
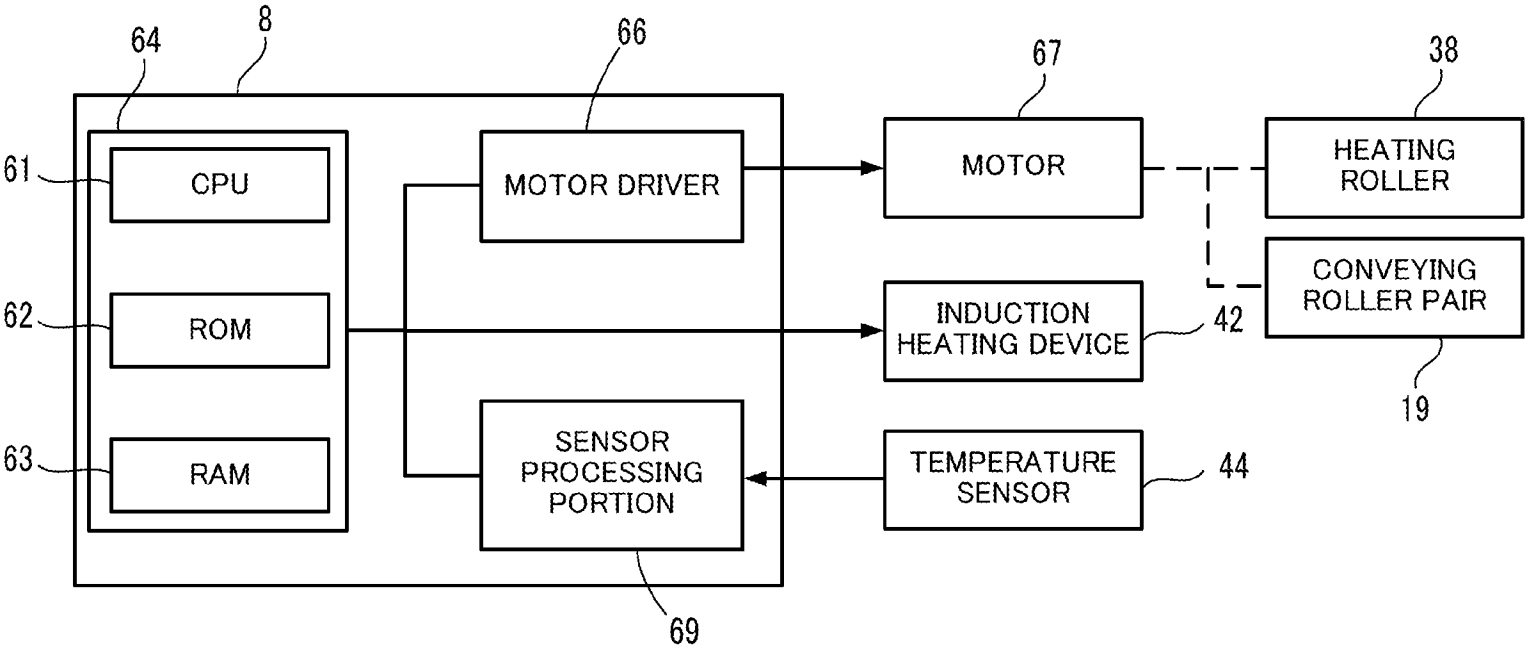
FIG. 2 is a block diagram showing the configuration of a control portion included in the image forming apparatus shown in FIG. 1.

The control portion 8 performs overall control of the image forming apparatus 10. That is, the control portion 8 controls, for example, the conveying operation of the conveying roller pairs 19, the transfer operation of the transfer device 15, and the fixing operation of the fixing device 18 in the image forming apparatus 10. As shown in FIG. 2, the control portion 8 includes a calculation portion 64 which includes a CPU 61, a ROM 62, and a RAM 63, the motor driver 66, a sensor processing portion 69, and the like. The calculation portion 64 performs heat generation control, fixing operation control, and the like described below in accordance with a predetermined program stored in the ROM 62 by the CPU 61. An operation control portion and an operation mode setting portion according to the present disclosure are achieved by the control portion 8 and the calculation portion 64.

In the present embodiment, the ROM 62 stores thresholds and the like used in heat generation control and fixing operation control described below. Specifically, the ROM 62 stores, for example, thresholds used in a determination process in step S17 described below and thresholds used in a determination process in step S20 described below.

The calculation portion 64 is electrically connected to the induction heating device 42 so that the calculation portion 64 controls the heat generation of the heating roller 38 using the induction heating device 42. For example, when the temperature of the heating roller 38 needs to be set to the second target temperature TH2 (175° C.) in order to fix a toner image on the print sheet P in the nip portion 82, the second target temperature TH2 is set as a setting temperature in the calculation portion 64 so that the temperature of the heating roller 38 is the second target temperature TH2. Then, the calculation portion 64 controls the heat generation of the heating roller 38 using the induction heating device 42 so that the temperature to be detected by the temperature sensor 44 is the setting temperature.

The motor driver 66 and the sensor processing portion 69 are configured by, for example, an electronic circuit such as an integrated circuit (ASIC) and an internal memory. The motor driver 66 is electrically connected to the motor 67. Based on an instruction signal from the calculation portion 64, the motor driver 66 controls the driving of the motor 67, whereby controlling the rotation of the heating roller 38 and the conveying roller pairs 19.

The sensor processing portion 69 is electrically connected to the temperature sensor 44. The sensor processing portion 69 converts an output signal received from the temperature sensor 44 into a digital signal. Based on the signal obtained by conversion by the sensor processing portion 69, the calculation portion 64 obtains the temperature of the heating roller 38.

Further, when the image forming apparatus 10 has not been used for a certain time period, the control portion 8 performs stoppage control for stopping the operations of the conveying roller pairs 19 and the induction heating device 42 in order to save power. Further, the control portion 8 performs control to maintain the temperature of the heating roller 38 of the fixing device 18 at a temperature (for example, 70° C. or lower, which is hereinafter referred to as a "standby temperature") lower than the fixing temperature (the first target temperature TH1 or the second target temperature TH2). Generally, an operation mode where the control portion 8 stops the operation of the induction heating device 42 is referred to as a power saving mode. Further, an operation mode where the surface temperature of the heating roller 38 is maintained at the standby temperature is referred to as a standby mode. Further, a control mode where the conveying roller pairs 19, the transfer device 15, and the heating roller 38 are caused to operate, while the surface temperature of the heating roller 38 is maintained at the fixing temperature (the first target temperature TH1 or the second target temperature TH2) so that printing can be immediately started is referred to as a print mode.

Incidentally, when the power saving mode of a conventional power saving function is applied to the image forming apparatus 10, for example, if a print job for forming an image on a single print sheet P (hereinafter referred to as a "single-sheet print job") has been input, first, the heat generation control of the induction heating device 42 that has been stopped is started, thereby raising the temperature of the heating roller 38 to the fixing temperature. Next, heat generation control for maintaining the fixing temperature is performed, and toner is fixed on the print sheet P during the control. When the print sheet P has passed through the fixing device 18, the heat generation control is stopped.

Thus, for example, when the single-sheet print job has been input multiple times, temperature rise control for raising the temperature of the heating roller 38 is repeated each time the single-sheet print job is input, depending on the intervals of the input of the single-sheet print job. In this case, the repetition of the temperature rise control wastefully consumes power. Particularly, the temperature rise control is control for rapidly heating the heating roller 38 from a predetermined temperature (for example, normal temperature) to the fixing temperature (for example, 175° C.), which enables the fixing of toner. Thus, the temperature rise control consumes a large amount of power. Consequently, the repetition of the temperature rise control wastefully consumes a large amount of power. On the other hand, for the single-sheet print job, setting values of the fixing temperature and the conveying speed may be made smaller to lengthen the fixing time. This makes it possible to perform the fixing operation while reducing the power consumption during the temperature rise control. In this case, the printing speed is reduced and the printing time is lengthened; however, an increase in the printing time is small in a print job for a small number of sheets such as the single-sheet print job. This reduces discomfort to be given to the user, and does not significantly reduce the user's convenience.

Further, also when a print job for forming images on a large number of (for example, 100) print sheets P (hereinafter referred to as a "multiple-sheet print job") has been input, the temperature rise control is performed after the input of the multiple-sheet print job. Thus, similarly to the case where the single-sheet print job has been input multiple times, when the multiple-sheet print job has been input multiple times, the repetition of the temperature rise control wastefully consumes power. When, however, a large number of sheets are to be printed, a problem with the lengthening of the printing time due to the reduction in the conveying speed is larger than a problem with the power consumed when the temperature rise control is performed. Thus, when the multiple-sheet print job has been input, it is desirable that the fixing operation should be performed without changing the setting values of the fixing temperature and the conveying speed, so as not to lengthen the printing time.

Only the single-sheet print job, however, may be input as an initial print job, and therefore, the temperature rise control may be performed by making smaller the setting values of the fixing temperature and the conveying speed. In this case, if the multiple-sheet print job has been input as a subsequent print job, the printing time of the subsequent multiple-sheet print job becomes long, which gives discomfort to the user and reduces the convenience. Further, also when a print job for a small number of sheets such as the single-sheet print job has been successively input as a subsequent print job, it takes time to complete all subsequent print jobs.

Further, when the multiple-sheet print job has been input as an initial print job, even if the single-sheet print job has been input after the multiple-sheet print job, it is desirable to perform the fixing operation without changing the setting values of the fixing temperature and the conveying speed. When, however, the multiple-sheet print job has been stopped after the input of the multiple-sheet print job, the fixing operation is performed on the subsequent single-sheet print job without changing the setting values of the fixing temperature and the conveying speed. In this case, as a result, power is wastefully consumed when the temperature rise control is performed.

Thus, in the present embodiment, the operation of the fixing device 18 is controlled so that the amount of power consumed when heat generation control is performed can be reduced in accordance with the content of a plurality of print jobs. Specifically, in the present embodiment, when the power saving mode or the standby mode transitions to the print mode, the control portion 8 controls the operation of the fixing device 18 based on either a first operation mode or a second operation mode described below. Here, the first operation mode is an operation mode where the control portion 8 controls the induction heating device 42 so that the temperature of the heating roller 38 is the first target temperature TH1 (145° C.), and also controls the heating roller 38 and the conveying roller pairs 19 so that the conveying speed of the print sheet P is the first speed V1. Further, the second operation mode is an operation mode where the control portion 8 controls the induction heating device 42 so that the temperature of the heating roller 38 is the second target temperature TH2 which is higher than the first target temperature TH1, and also controls the heating roller 38 and the conveying roller pairs 19 so that the conveying speed of the print sheet P is the second speed V2 which is faster than the first speed V1.

More specifically, when the image forming apparatus 10 is in the power saving mode or the standby mode, the control portion 8, under the condition that a predetermined print job (hereinafter referred to as a "first print job") has been input, sets a mode setting item in a register of the CPU 61 so that the fixing device 18 operates in the first operation mode. Further, when a print job (hereinafter referred to as a "second print job") different from the first print job has been input after the input of the first print job, the control portion 8 can shift the operation mode of the fixing device 18 from the first operation mode to the second operation mode based on the content of the second print job.

[Heat Generation Control and Fixing Operation Control]

Figure 3:
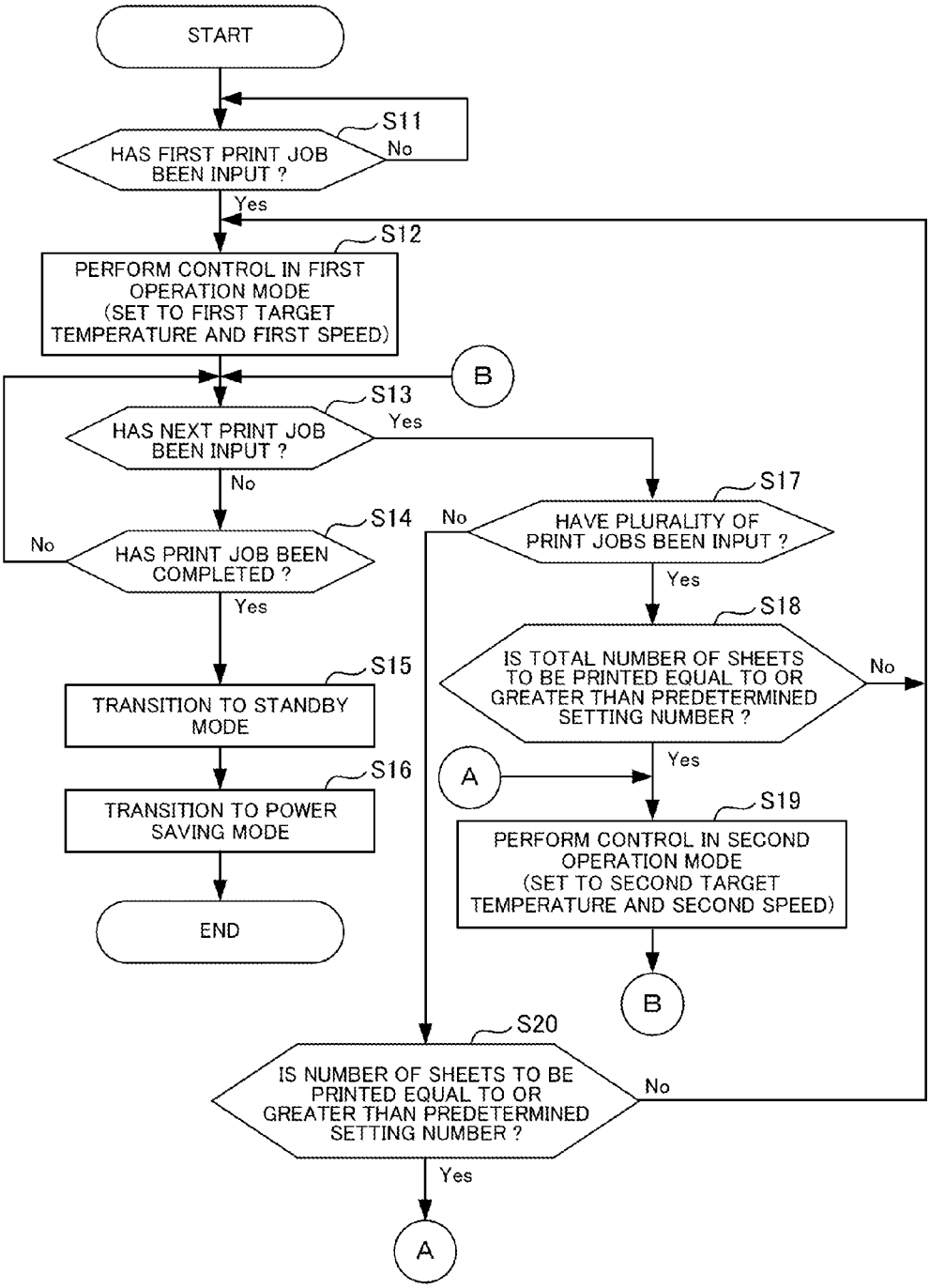
FIG. 3 is a flow chart showing the procedure of fixing operation control performed by the control portion shown in FIG. 2.
Figure 4A:
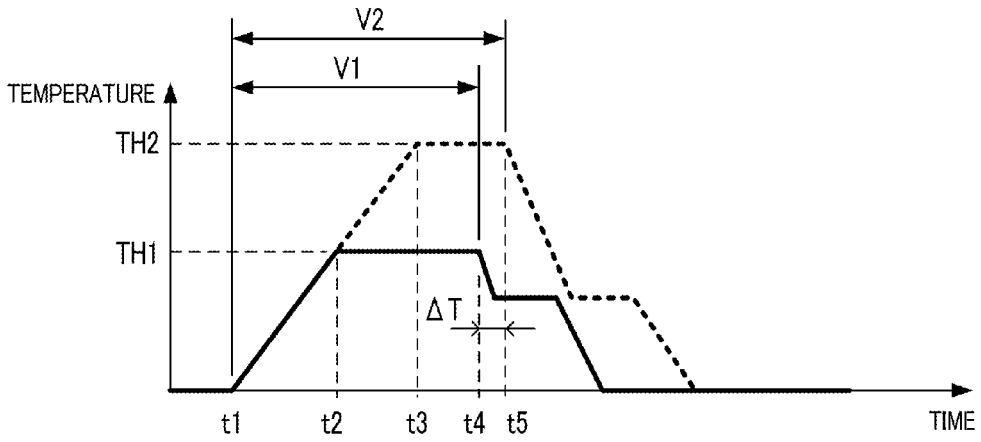
FIG. 4A is a diagram showing the state of the operation of a fixing device shown in FIG. 1, and is a graph showing the relationship between an elapsed time and a fixing temperature when a single-sheet print job has been input.
Figure 4B:
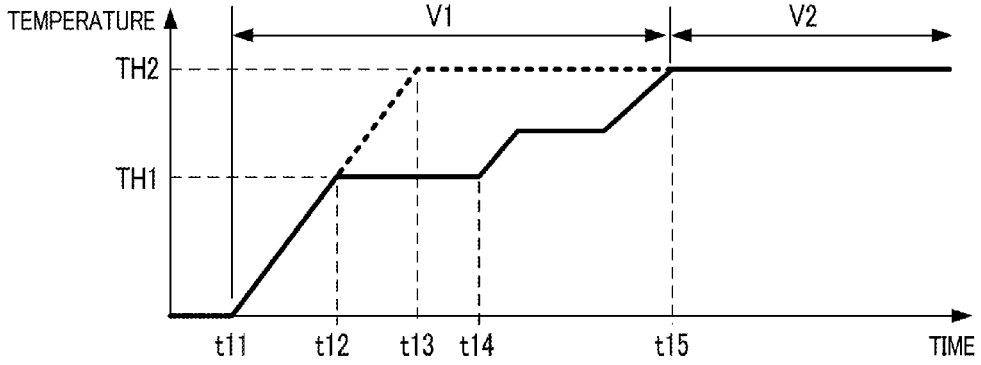
FIG. 4B is a diagram showing the state of the operation of the fixing device shown in FIG. 1, and is a graph showing the relationship between an elapsed time and a fixing temperature when a multiple-sheet print job has been input.

Next, with reference to a flow chart of FIG. 3 and graphs of FIGS. 4A and 4B, a description is given of examples of the procedures of heat generation control and fixing operation control performed by the control portion 8. In FIG. 3, "S11", "S12", . . . represent the numbers of processes (steps). The process of each step is performed by the control portion 8, more specifically, by the CPU 61 of the calculation portion 64 executing a program in the ROM 62. It should be noted that in the following description, at the time of step S11, the image forming apparatus 10 is in the power saving mode, that is, in the state where the control of the heat generation of the heating roller 38 using the induction heating device 42 is stopped.

First, in step S11, the control portion 8 determines whether or not the first print job has been input. The first print job may not be a particular print job, and may be any print job. That is, in step S11, it is determined whether or not an unspecified print job has been input when the image forming apparatus 10 is operating in the power saving mode. When the first print job has not been input in step S11, the power saving mode is maintained. When, on the other hand, the first print job has been input in step S11, then in step S12, the fixing operation is controlled based on the first operation mode. That is, the induction heating device 42 controls the heat generation of the heating roller 38 is controlled by using the induction heating device 42 so that the temperature of the heating roller 38 is the first target temperature TH1 (145° C.). Further, the rotations of the heating roller 38 and the conveying roller pairs 19 are controlled so that the conveying speed of the print sheet P is the first speed V1. Here, steps S11 and S12 correspond to a first step of a fixing operation control method according to the present disclosure.

Next, in step S13, the control portion 8 determines whether or not a next print job (the second print job) has been input. Here, when a next print job has not been input (No in S13) and the first print job has been completed (Yes in S14), the operation mode transitions to the standby mode (S15). Further, when a predetermined time has elapsed, the operation mode transitions to the power saving mode (S16), and the series of processes end.

Here, as shown in FIG. 4A, for example, the case is considered where a print job for forming an image on a single print sheet P (the single-sheet print job) has been input as the first print job. In this case, in a conventional operation mode, as indicated by a dashed line in the graph, when the single-sheet print job has been input at a time t1, temperature rise control is performed until a time t3, and the temperature of the heating roller 38 rises to the second target temperature TH2. Then, constant temperature control is performed until a time t5, and the fixing operation is performed. In the fixing operation at this time, the heating roller 38 is driven to rotate so that the conveying speed of the print sheet P is the second speed V2. Then, the fixing operation is completed at the time t5, and if a next print job has not been input, the operation mode transitions to the standby mode and then transitions to the power saving mode. On the other hand, as shown in FIG. 4A, in the present embodiment, when the single-sheet print job has been input, if the fixing operation is performed in the first operation mode, then as indicated by a solid line in the graph, heat generation control is started at the time t1, and temperature rise control is performed until a time t2, and the temperature of the heating roller 38 rises to the first target temperature TH1. Then, constant temperature control is performed until a time t4, and the fixing operation is performed. In the fixing operation at this time, the heating roller 38 is driven to rotate so that the conveying speed of the print sheet P is the first speed V1. In the present embodiment, the first speed V1 is half the second speed V2. As shown in FIG. 4A, however, the temperature rise time to reach the first target temperature TH1, which is the fixing temperature, is shorter than the conventional temperature rise time, and the fixing operation is started at an earlier time. Thus, the time t4, when the fixing operation is completed, is ΔT earlier than the completion time t5 of the fixing operation in the conventional operation mode. As a result, the fixing operation is performed at the first target temperature TH1, which is lower than the second target temperature TH2, and therefore, it is possible to reduce more power consumed when the temperature rise control is performed from the power saving mode as compared to the conventional operation mode. Further, the time until the completion of the fixing operation is ΔT shorter than that in the conventional operation mode. This increases the speed of the fixing process.

When a next print job (the second print job) has been input in step S13, then in step S17, the control portion 8 determines whether a single print job has been input or a plurality of print jobs have been input. Here, when a plurality of print jobs have been input, the control portion 8 determines whether or not the total number of sheets to be printed in the plurality of print jobs is equal to or greater than a predetermined setting number (S18). Here, when the total number of sheets to be printed is equal to or greater than the predetermined setting number, then in step S19, the control portion 8 controls the fixing operation based on the second operation mode to shorten the printing process time rather than to reduce the power consumption. That is, the induction heating device 42 is controlled to generate heat from the heating roller 38 so that the temperature of the heating roller 38 is the second target temperature TH2 (175° C.). Further, the rotations of the heating roller 38 and the conveying roller pairs 19 are controlled so that the conveying speed of the print sheet P is the second speed V2. Then, the processing returns to step S13, and the processes of step S13 and thereafter are repeated. Here, steps S17 to S19 correspond to a second step of the fixing operation control method according to the present disclosure. It should be noted that when the total number of sheets to be printed is less than the predetermined setting number in step S18, the processing returns to step S12, and the fixing operation is controlled based on the first operation mode.

When it has been determined in step S17 that the next print job is a single print job, the control portion 8 determines whether or not the number of sheets to be printed in the input print job is equal to or greater than the predetermined setting number (S20). Here, when it has been determined that the number of sheets to be printed is equal to or greater than the predetermined setting number, the processing proceeds to step S19, and the fixing operation is controlled based on the second operation mode. When, on the other hand, the number of sheets to be printed is less than the predetermined setting number, the processing returns to step S12, and the processes of step S12 and thereafter are repeated. It should be noted that to improve the user's convenience, it is desirable that the user should be allowed to optionally set the predetermined setting number.

Here, as shown in FIG. 4B, for example, the case is considered where a print job for forming images on a large number of (for example, 100) print sheets P (the multiple-sheet print job) has been input as the second print job. In this case, in a conventional operation mode, as indicated by a dashed line in the graph, when the multiple-sheet print job has been input at a time t11, temperature rise control is performed until a time t13, and the temperature of the heating roller 38 rises to the second target temperature TH2. Then, the heating roller 38 is controlled at a constant temperature, namely the second target temperature TH2, until the multiple-sheet print job is completed. On the other hand, as shown in FIG. 4B, in the present embodiment, when the first print job has been input, the fixing operation is controlled always in the first operation mode. Then, when the multiple-sheet print job has been input, only if the number of sheets to be printed is equal to or greater than the predetermined setting number, the first operation mode transitions to the second operation mode. In other words, in the present embodiment, even when the second print job has been input after the first print job, if the number of sheets to be printed is less than the predetermined setting number, the fixing operation is controlled in the first operation mode without transitioning to the second operation mode, in order to achieve the reduction of the power consumption rather than the shortening of the printing time. It should be noted that in the second operation mode, it is desirable that after the temperature of the heating roller 38 has reached the second target temperature TH2 from first target temperature TH1, the control portion 8 should control the rotational speed of the heating roller 38 and the like so that the conveying speed of the print sheet P changes from the first speed V1 to the second speed V2. This can prevent a fixing failure due to the conveying speed of the print sheet P changing to the second speed V2 in the state where the temperature of the heating roller 38 has not risen from the first target temperature TH1 to the second target temperature TH2.

The image forming apparatus 10 according to the embodiment of the present disclosure is thus configured, and therefore, it is possible to, in accordance with the content of a plurality of print jobs, reduce the amount of power consumed when the induction heating device 42 is controlled to generate heat from the heating roller 38. Further, when the multiple-sheet print job has been input as the first print job, the fixing operation is controlled in the first operation mode until the number of sheets to be printed reaches the predetermined setting number. Then, when the fixing temperature has risen to the second target temperature TH2 and the fixing temperature has reached the second target temperature TH2, the rotational speeds of the heating roller 38 and the like are controlled so that the conveying speed of the print sheet P is the second speed V2. Thus, the fixing operation of the fixing device 18 is controlled in the second operation mode.

It should be noted that in the above embodiment, a description has been given of an example where, when the total number of sheets to be printed is equal to or greater than the predetermined number in step S18, the fixing operation is controlled in the second operation mode. The present disclosure, however, is not limited to this example. For example, immediately after the single-sheet print job for forming an image on a single sheet has been continuously input as the second print job multiple times, the fixing operation may be controlled in the second operation mode.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a heat transfer portion configured to transfer heat to a sheet on which an image is to be formed, to heat the sheet;

a heating portion configured to raise a temperature of the heat transfer portion;

a conveying portion configured to convey the sheet;

an operation control portion configured to perform control in either operation mode of: a first operation mode where the operation control portion controls the heating portion so that the temperature of the heat transfer portion is a first target temperature, and also controls the conveying portion so that a conveying speed of the sheet is a first speed; and a second operation mode where the operation control portion controls the heating portion so that the temperature of the heat transfer portion is a second target temperature which is higher than the first target temperature, and also controls the conveying portion so that the conveying speed of the sheet is a second speed which is faster than the first speed; and an operation mode setting portion configured to, under the condition that a first print job has been input, set the operation mode of the operation control portion to the first operation mode, and when a second print job input after the first print job has satisfied a predetermined condition, set the operation mode of the operation control portion to the second operation mode by allowing the first operation mode to transition to the second operation mode; wherein when the first print job is input in a state where the image forming apparatus is in a power saving mode, the power saving mode transitions to a print mode in which printing on the sheet is possible, and the operation mode of the operation control portion is set to the first operation mode;

in the print mode, when a number of sheets represented by the second print job input after the first print job is equal to or greater than a predetermined setting number, the operation mode of the operation control portion is set to the second operation mode by allowing the first operation mode to transition to the second operation mode; and when, after the first print job, a plurality of print jobs including the second print job in which the number of sheets is less than the predetermined setting number have been continuously input, the operation mode of the operation control portion is maintained at the first operation mode if a total number of sheets to be printed by the plurality of print jobs is less than the predetermined setting number, and the operation mode of the operation control portion is set to the second operation mode by allowing the first operation mode to transition to the second operation mode if the total number of sheets to be printed by the plurality of print jobs is equal to or greater than the predetermined setting number.

2. The image forming apparatus according to claim 1, wherein, as the second print job, a print job for forming an image on a single sheet is continuously input multiple times.

3. The image forming apparatus according to claim 1, wherein, after the temperature of the heat transfer portion has risen from the first target temperature to the second target temperature in the second operation mode, the operation control portion controls the conveying portion so that the conveying speed of the sheet changes from the first speed to the second speed.

4. A fixing operation control method applied to an image forming apparatus that includes: a conveying portion configured to convey a sheet on which an image is to be formed; a heat transfer portion configured to transfer heat to the sheet conveyed by the conveying portion to heat the sheet; and a heating portion configured to raise a temperature of the heat transfer portion, the fixing operation control method comprising:

a first step of, under the condition that a first print job has been input, controlling the heating portion so that the temperature of the heat transfer portion is a first target temperature, and also controlling the conveying portion so that a conveying speed of the sheet is a first speed; and a second step of, when a second print job input after the first print job has satisfied a predetermined condition, controlling the heating portion so that the temperature of the heat transfer portion is a second target temperature which is higher than the first target temperature, and also controlling the conveying portion so that the conveying speed of the sheet is a second speed which is faster than the first speed;

a third step of, when a first print job is input in a state where the image forming apparatus is in a power saving mode, transitioning from the power saving mode to a print mode in which printing on the sheet is possible, and controlling the heating portion so that the temperature of the heat transfer portion is the first target temperature, and also controlling the conveying portion so that the conveying speed of the sheet is the first speed;

a fourth step of, in the print mode, when the number of sheets represented by the second print job input after the first print job is equal to or greater than a predetermined setting number, controlling the heating portion so that the temperature of the heat transfer portion is the second target temperature, and also controlling the conveying portion so that the conveying speed of the sheet is the second speed; and a fifth step of, when, after the first print job, a plurality of print jobs including the second print job in which the number of sheets is less than the predetermined setting number have been continuously input, maintaining the temperature of the heat transfer portion at the first target temperature and maintaining the conveying speed of the sheet at the first speed if a total number of sheets to be printed by the plurality of print jobs is less than the predetermined setting number, and controlling the heating portion so that the temperature of the heat transfer portion is the second target temperature and controlling the conveying portion so that the conveying speed of the sheet is the second speed if the total number of sheets to be printed by the plurality of print jobs is equal to or greater than the predetermined setting number.

* * * * *